United States Patent [19]

Iwasawa et al.

[11] Patent Number: 4,707,408

[45] Date of Patent: Nov. 17, 1987

[54] ROLL FOR USE IN BUSINESS MACHINE

[75] Inventors: Shigeru Iwasawa, Kamakura; Takumi Ishiwaka, Yokohama, both of Japan

[73] Assignee: Bridgestone Corporation, Tokyo, Japan

[21] Appl. No.: 836,990

[22] Filed: Mar. 6, 1986

[30] Foreign Application Priority Data

Mar. 8, 1985 [JP] Japan ..... 60-32871[U]

[51] Int. Cl.[4] ..... D02G 3/00

[52] U.S. Cl. ..... 428/379; 428/36; 428/65; 428/71; 428/318.6; 428/318.8; 428/319.1; 428/357; 428/375; 428/383; 428/425.8

[58] Field of Search ..... 428/357, 375, 379, 383, 428/425.8, 71, 36, 65, 319.1, 318.6, 318.8

[56] References Cited

U.S. PATENT DOCUMENTS

| | | | |
|---|---|---|---|
| 2,753,276 | 7/1956 | Brochhagen et al. | 428/319.1 |
| 2,916,403 | 12/1959 | Calderwood | 428/425.8 |
| 2,959,508 | 11/1960 | Graham et al. | 428/318.8 |
| 4,576,845 | 3/1986 | Krotchko | 428/425.8 |
| 4,576,970 | 3/1986 | Ganster et al. | 428/318.8 |
| 4,579,775 | 4/1986 | Ohta et al. | 428/318.8 |

FOREIGN PATENT DOCUMENTS

| | | | |
|---|---|---|---|
| 711680 | 6/1965 | Canada | 428/425.8 |
| 1565801 | 8/1980 | United Kingdom | 428/425.8 |

OTHER PUBLICATIONS

Zwolinsky, L. M., SPE Journal, "Molded Integral-Skin Urethane Foam", vol. 25, pp. 24–27, 1969.

*Primary Examiner*—Lorraine T. Kendell
*Assistant Examiner*—S. A. Gibson
*Attorney, Agent, or Firm*—Birch, Stewart, Kolasch & Birch

[57] ABSTRACT

A roll for use in business machines has a shaft and a roll main body disposed at the circumference of said shaft, wherein the roll main body is made of a polyurethane resin comprising a surface layer composed of a skin layer and an inner layer composed of a foam layer which are formed into an integrated structure. The roll is suitably used for removing residual toners on the photo-sensitive drum in dry process copying machines.

4 Claims, 3 Drawing Figures

ROLL FOR USE IN BUSINESS MACHINE

BACKGROUND OF THE INVENTION

This invention concerns a roll for use in business machines and, more particularly, it relates to a roll suitably used for removing residual toners on the photosensitive drum in dry process copying machines.

Rolls made of silicone rubber have generally been used as the roll for removing residual toners on the photosensitive drum in dry process copying machines (cleaning roller). As shown in FIG. 3, the silicone rubber roll comprises an inner layer 2 made of foamed silicone rubber formed to the circumference of a larger diameter body portion 1*a* at the middle part of a metal shaft 1 and a surface layer 3 made of non-foamed silicone rubber disposed along the circumference of the inner layer 2.

However, the silicone rubber roller mentioned above involves the following problems:

(1) Since expensive silicone rubber is used as the material and the inner and outer layers are formed separately, the production cost is considerably high.

(2) The use of highly heat resistant silicone rubber is not reasonable but wasteful in view of the balance between the required performance and the properties of the material since the material used for the cleaning roller has only to withstand the temperature of about 50° C. as the operation temperature of the photosensitive drum. However, since no satisfactory materials have been available with respect to the moderate elasticity and releasing property required upon cleaning, the use of the silicone rubber has been inevitable.

SUMMARY OF THE INVENTION

The object of this invention is to provide a roll having satisfactory abrasion resistance and moderate elasticity and being capable of easy fabrication at a reduced cost for use in business machines, for example, dry process copying machine, facsimile machine, printer and like other information equipments.

The above object can be attained in accordance with this invention by a roll for use in business machines having a shaft and a roll main body disposed at the circumference of the shaft, wherein the roll main body is made of a polyurethane resin comprising a surface layer composed of a skin layer and an inner layer composed of a foamed layer which are formed into an integrated structure.

Since the roll according to this invention uses an inexpensive polyurethane resin as the material for constituting the roll main body and the manufacturing step can be simplified by simultaneously molding the surface skin layer and the inner foamed layer by the integrated molding of the urethane resin, it can be manufactured at an extremely reduced cost.

In addition, the roll made of the polyurethane resin according to this invention has a good abrasion resistance and a moderate elasticity and can be manufactured with ease so as to agree with the required performance. Furthermore, since the physical properties of the layers can optinally be varied, the roll can be applied to all sorts of rollers for use in dry process copying machines, as well as to rolls for use in facsimiles, printers and other like information equipment.

Particularly, the roll according to this invention can suitably be used for removing the residual toners on the photosensitive drum in dry process copying machines. In this application use, since the polyurethane resin inexpensive and excellent in abrasion resistance is used and the inner layer composed of the foam and the surface layer composed of the skin are disposed in the integrated structure for sufficiently attaining the required performance as the cleaning roll in this invention, the inner foam layer contributes to the elastic function upon pressing and the surface skin layer effectively acts on the photosensitive drum for removing the toners.

BRIEF DESCRIPTION OF THE ACCOMPANYING DRAWINGS

The above and other objects, features and advantages of the invention will become more apparent from the following description and claims taken in conjugation with the accompainying drawings, in which:

FIGS. 1 and 2 show one embodiment of the roll according to this invention, in which FIG. 1 is a perspective view and FIG. 2 is a cross sectional view; and FIG. 3 is a perspective view illustrating a conventional roll.

DESCRIPTION OF PREFERRED EMBODIMENT

Figure 1:
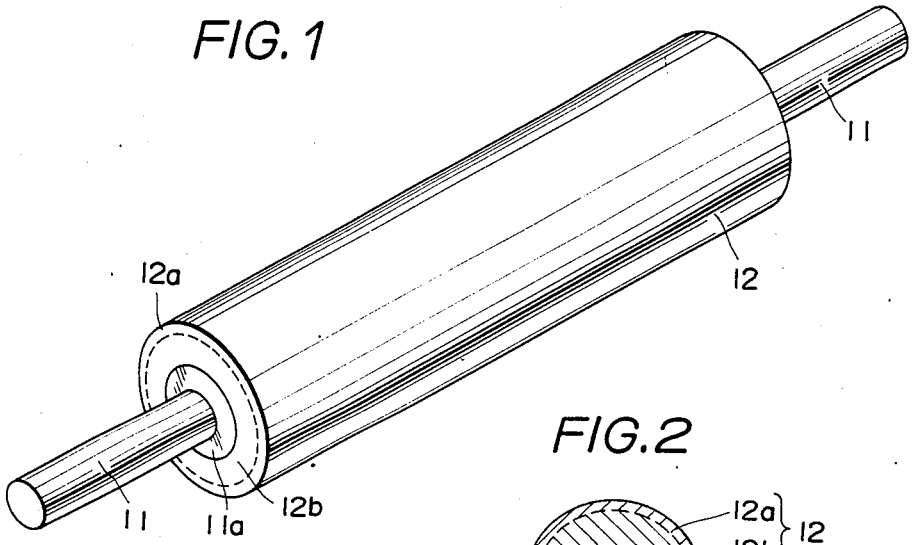
Figure 2:
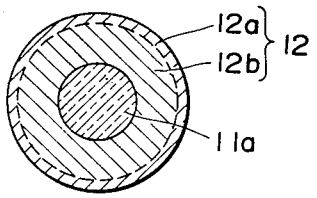
Figure 3:
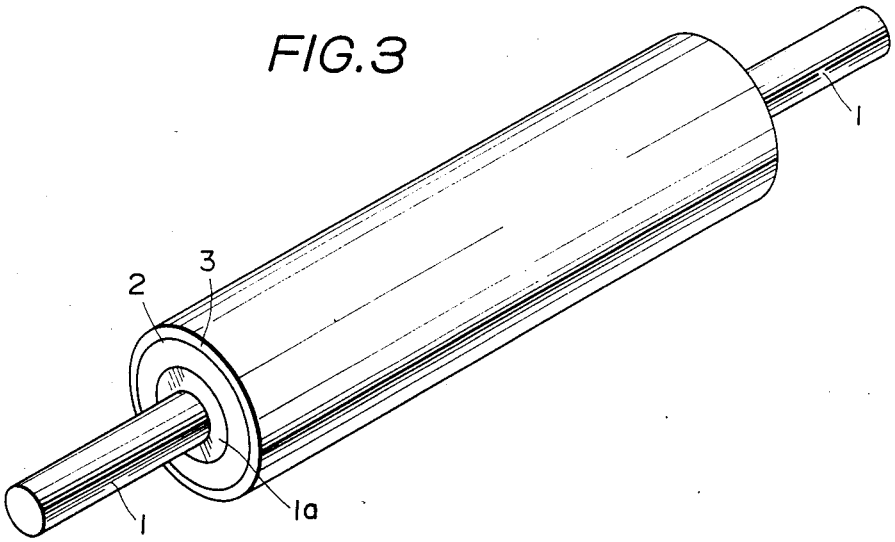

One embodiment of the roll according to this invention is shown in FIGS. 1 and 2, although the invention is not necessarily limited only to such an embodiment. In the drawings, a shaft 11 is made of metal such as steel or aluminum alloy and formed with a somewhat larger diameter body portion 11*a* at the middle part thereof. A cylindrical roll main body 12 comprising a surface layer 12*a* composed of a polyurethane resin skin and an inner layer 12*b* composed of a polyurethane resin foam at the inside thereof is integrally disposed on the outer circumferential surface of the body portion 11*a* of the shaft 11. The roll main body 12 is integrally and simultaneously molded from the skin of the surface layer 12*a* and the foam of the inner layer 12*b* by means of integral skin process or the like, in which the foam of the surface layer 12*a* is gradually and continuously transformed into the skin of the inner layer 12*b* with no distinct interface between both of the layers 12*a* and 12*b*. In view of the above, the interface between both of the layers 12*a* and 12*b* is depicted by a broken line in the drawing.

Referring more specifically to the foamed material comprising the surface layer as the skin layer and the inner layer as the foamed layer prepared by the integral skin process, the skin layer has a thickness of about 0.1–3 mm with an average density of from 0.8 to 1.2 g/cm$^3$, which is transformed into the adjacent foam layer having a thickness of about 7–10 mm with an average density of from 0.05 to 0.1 g/cm$^3$ while continuously varying the densty at a considerably abrupt slope. The thickness of the foam layer is preferably defined from 7 to 10 mm as described above, and it may optionally be varied while considering the elasticity as required. The integral skin process can be carried out by the conventional procedure.

The roll of such a structure is manufactured by an integral skin process or the like which comprises disposing the shaft 11 at the center of a cylindrical molding die, pouring a mixture of polyol, isocyanate and foaming agent to the periphery of the shaft 11 and foaming the mixture thereby molding the leather-like skin and the elastic foam simultaneously. If required, the surface of the skin of the surface layer 12*a* may be polished to further improve the smoothness.

The roll can suitably be used for removing the residual toners on the photosensitive drum in dry process copying machines. In this application use, since the polyuethane resin inexpensive and excellent in the abrasion resistance is used and the inner layer composed of the foam and the surface layer composed of the skin are disposed in the integrated structure for sufficiently attaining the required performance as the cleaning roll in this invention, the inner foam layer 12*b* contributes to the elastic function upon pressing and the surface skin layer 12*a* effectively acts on the photosensitive drum for removing the toners. Furthermore, since the physical properties of the layers can optionally be varied, the roll can be applied to all sorts of rollers for use in dry process copying machines, as well as to rolls for use in facsimiles, printers and the like other information equipments. In this case, elasticity suitable to various application uses can be provided by setting the specific gravity of the foam from 0.05 to 0.6 g/cm$^3$.

What is claimed is:

1. A roll for use in a business machine comprising: a shaft; and a roll main body disposed at the circumference of said shaft, wherein the roll main body is made of a polyurethane resin comprising a surface layer composed of a skin layer and an inner layer composed of a foam layer which are formed into an integrated structure by an integral skin process so that the foam of the surface layer is gradually and continuously transformed into the skin of the inner layer with no distinct interface between both of the layers.

2. The roll for use in a business machine as defined in claim 1, wherein the skin layer has a thickness of about 0.1–3 mm with an average density of from 0.8 to 1.2 g/cm$^3$, which is transformed into the adjacent the foam layer having a thickness of about 7–10 mm with an average density of from 0.05 to 0.6 g/cm$^3$ while continuously varying the density at a considerably abrupt slope.

3. The roll for use in a business machine as defined in claim 1, which is prepared by disposing said shaft at the center of a cylindrical molding die, pouring a mixture of polyol, isocyanate and foaming agent to the periphery of the said shaft and foaming the mixture to simultaneously form said roll having an elastic foam and a leather like skin.

4. The roll for use in a business machine as defined in claim 3, wherein the surface layer of said skin is polished to improve the smoothness thereof.

* * * * *